US008905869B2

(12) United States Patent
Grover

(10) Patent No.: US 8,905,869 B2
(45) Date of Patent: Dec. 9, 2014

(54) BASKETBALL SHOOTING TRAINING DEVICE AND METHOD

(76) Inventor: Tim Singh Grover, Chicago, IL (US)

( * ) Notice: Subject to any disclaimer, the term of this patent is extended or adjusted under 35 U.S.C. 154(b) by 181 days.

(21) Appl. No.: 13/465,861

(22) Filed: May 7, 2012

(65) Prior Publication Data

US 2012/0283049 A1 Nov. 8, 2012

Related U.S. Application Data

(60) Provisional application No. 61/483,470, filed on May 6, 2011.

(51) Int. Cl.
*A63B 69/00* (2006.01)

(52) U.S. Cl.
CPC ..... *A63B 69/0071* (2013.01); *A63B 69/0059* (2013.01)
USPC ..... 473/450; 473/447

(58) Field of Classification Search
USPC ..... 473/477, 450, 447; 2/16, 21; D29/114
See application file for complete search history.

(56) References Cited

U.S. PATENT DOCUMENTS 1,554,633 A * 9/1925 Ingram ..... 273/145 A
1,787,660 A * 1/1931 Blakeley ..... 401/8
1,887,278 A * 11/1932 Auster ..... 2/20
3,398,951 A * 8/1968 Disko ..... 473/61
3,888,482 A * 6/1975 Starrett et al. ..... 473/458
4,689,828 A 9/1987 Brewer
4,805,905 A 2/1989 Haub
4,836,539 A 6/1989 Knapp
4,881,275 A 11/1989 Cazares et al.
4,919,425 A 4/1990 Wolf
5,135,217 A 8/1992 Swain
5,149,085 A 9/1992 Sanchez
5,228,682 A 7/1993 Wolf
5,636,381 A 6/1997 Brogden
5,651,743 A 7/1997 Stephan et al.
5,769,743 A 6/1998 Stephan et al.
D400,308 S 10/1998 Paparella et al.
5,816,952 A 10/1998 Blevins
5,947,915 A * 9/1999 Thibodo, Jr. ..... 602/5
6,095,936 A 8/2000 Kirkpatrick et al.
6,283,877 B1 9/2001 Cook
6,645,093 B2 11/2003 Sheppard
6,729,979 B1 5/2004 Sullivan
6,732,374 B1 * 5/2004 Blair ..... 2/20

(Continued)

OTHER PUBLICATIONS

Webpage download, ShootersFork, 2010, www.amazon.com/Unique-SF-2-Shooters-Fork/dp/B00307J33A/,4 pages.*

(Continued)

*Primary Examiner* — Gene Kim
*Assistant Examiner* — M Chambers
(74) *Attorney, Agent, or Firm* — Fitch, Even, Tabin & Flannery LLP

(57) ABSTRACT

The disclosure relates to a device for training proper finger spacing on a basketball ball at the time of releasing the ball. The basketball training devices provided herein maintain two adjacent fingers in comfortably spaced relation to enable the player to support and release the ball from those two fingers, thereby increasing the player's control of the ball and improving the accuracy of the basketball shot. A method for maintaining two adjacent fingers of a basketball player's hand in spaced and angled relation when shooting a basketball is provided. A method for making the training device is also provided.

18 Claims, 10 Drawing Sheets

(56) References Cited

U.S. PATENT DOCUMENTS

| | | | | |
|---|---|---|---|---|
| 7,442,133 | B2 | 10/2008 | Wolf | |
| 2003/0130074 | A1* | 7/2003 | Petroskey | 473/463 |
| 2006/0163890 | A1* | 7/2006 | Namiki | 294/25 |
| 2007/0021700 | A1* | 1/2007 | Liebowitz | 602/22 |
| 2007/0238558 | A1* | 10/2007 | Graham | 473/477 |
| 2007/0270247 | A1 | 11/2007 | Wolf | |
| 2009/0318248 | A1 | 12/2009 | Russotti | |
| 2012/0283049 | A1* | 11/2012 | Grover | 473/450 |

OTHER PUBLICATIONS

"Shotlock," product believed to be publicly available at least since May 6, 2011, 1 page.

"Shooters Fork," product believed to be publicly available at least since May 6, 2011, 1 page.

* cited by examiner

BASKETBALL SHOOTING TRAINING DEVICE AND METHOD

CROSS REFERENCE TO RELATED APPLICATION

This application claims the benefit of U.S. Provisional Application No. 61/483,470, filed May 6, 2011, which is incorporated herein by reference in its entirety.

FIELD

The disclosure relates to basketball shooting training devices and methods.

BACKGROUND

Basketball players of all ages and skill levels often desire to improve their basketball shooting technique. There are many aspects to good shooting technique, including stance, position of the fingers on the ball, and position of the elbow and shoulder during release and follow-through when shooting the basketball. Even professional basketball players find that there is room for improvement in one or more aspects of their technique and form.

Players often struggle with inconsistent aim and control of the ball during shooting. One particular aspect of the shooting process that can benefit from refinement is the position and spacing of the player's fingers on the basketball at the time of releasing the shot. Finger spacing during release is an often underappreciated but important element of the accuracy of the player's aim. Also, players often shift the position of their fingers on the ball during the act of shooting so that the ball last touches the player's longest finger when the ball is released. Movement and improper position of the fingers on the ball can both contribute to inconsistent and inaccurate shooting. Rather than releasing the ball from the fingertips almost simultaneously, the longer finger stays in contact with the ball longer, which potentially puts a side spin on the ball rather than the desired back spin.

U.S. Pub. No. 2007/0238558 describes an apparatus for assisting in teaching proper technique in holding and shooting a basketball. The apparatus has a one-piece construction with a generally V-shaped member having a concave surface on a first leg portion engageable with an inner surface of an index finger and a concave surface on a second leg portion engageable with an inner surface of a middle finger for spreading the index and middle fingers apart. The apparatus is described as being formed from a predetermined material selected from the group consisting of plastic and aluminum.

A commercially-available device marketed as the SHOOTERS FORK™ from Unique Sports Products Inc. (Alpharetta, Ga.) is a one-piece component configured to fit between adjacent fingers on the shooting hand. The device includes a generally wedge-shaped portion having a concave surface on a first side of the wedge engageable with an inner surface of an index finger and a concave surface on a second side of the wedge engageable with an inner surface of a middle finger. A pair of loop portions is integrally formed with the wedge-shaped portion so that they each have their opposite ends integrally connected to one side or the other adjacent the side surfaces of the wedge portions. In this manner, the loop portions extend laterally outward from the wedge portion sides to be configured to encircle the index and middle fingers. Thus, when worn, the purpose is for the index and middle fingers to be spaced apart for improved basketball shooting. However, to provide for comfort to the wearer, the device is of a soft and pliable silicone material, such that when it is worn, it allows for substantial movement of the index and middle fingers in all directions, including back toward one another. In this regard, the wedge portion has several openings at the top and extending toward the bottom thereof making it highly deformable and thus very easy to deform and compress between the fingers extending through the loop portions.

The currently available training devices and devices have failed to provide a comfortable but effective way of training proper finger spacing on a basketball ball at the time of releasing the ball.

SUMMARY

A basketball training device for maintaining proper finger spacing on a basketball at the time of releasing the ball is provided. The basketball training device maintains two adjacent fingers in substantially spaced and angled relation to enable the player to support and release the ball from those two fingers, thereby increasing the player's control of the ball and improving the accuracy of the basketball shot.

In a preferred form, the training device includes a generally rigid wedge portion configured to fit between two adjacent fingers on the player's shooting hand so that the fingers are comfortably spread apart and maintained in spaced and angled relation. In particular, the rigid wedge portion is configured to maintain a substantially fixed, minimum spread between the adjacent fingers, typically the index finger and the middle finger, so that these fingers are substantially restricted from being shifted closer to each beyond the minimum spread therebetween. By spreading the fingers apart by about 25 to about 40 degrees, for instance, the effect of having fingers of differing lengths is minimized when the fingers are positioned on the ball in spaced and angled relation. When the player's fingers are placed on the ball with the generally rigid wedge portion positioned between two fingers of different lengths to spread them apart, a line extending across the distal ends of the spread fingers will more closely run parallel to the ground rather than obliquely relative thereto. In one aspect, it is preferred that the training device be configured to be oriented between the adjacent fingers below the knuckles of the player's fingers so that the player can still bend his or her fingers normally and to minimize interference with dribbling, passing, and shooting motions.

In one form, the training device has two distinct components, including includes a generally rigid central wedge member and a separate, resilient and flexible band member secured thereto. The components are configured so that, when worn, a player's index and middle fingers are provided with differing resistance to movement toward and away from each other. More particularly, due to the generally rigid wedge member and the separate resilient and flexible band member, the training device described herein provides greater resistance to lateral inward movement of the fingers toward each other over the resistance to laterally outward movement of the fingers away from each other. In this regard, since the generally rigid wedge member already spreads the fingers close to their maximum spread without causing discomfort, additional spreading of the fingers generally is not of a significant concern. As such, the resilient and flexible band readily and comfortably accommodates slight lateral outward movements of the fingers while still functioning to gently urge the fingers back toward engagement with the wedge body in their proper spread alignment for shooting.

The band member preferably is adhered to the central wedge member including a wedge body and is sized to extend about the wedge body to form two openings on opposite sides of the central wedge body, with each opening sized to permit passage of a player's finger therethrough. The central wedge body has opposite side surfaces, each configured to contact the side of one of the adjacent fingers. By one approach, the side surfaces have a generally concave configuration and extend between a lower narrow end and an upper wider end of the wedge body. When the training device is worn, the narrow end of the central wedge body is positioned adjacent the base between two fingers, and at the wider end, the body is positioned below or aligned with the knuckles of the player. For this purpose, the opposite side surfaces diverge away from each other from the narrowed end to the wider end of the central wedge body.

The configuration of the central wedge body including the side surfaces thereof serves to separate and maintain the player's index and middle fingers in spaced and angled relation. The spacing of the fingers minimizes the effects of having fingers of different lengths so that two adjacent fingers can both stably support the ball prior to and during the shot. The effective lengths of the two adjacent fingers of differing length can be substantially equalized to provide greater control during release of the ball and improved shooting technique when wearing the training device.

The central wedge body of the training device can take on a variety of configurations but preferably is a solid wedge formed of a resiliently compressible material. In another aspect, the central wedge body can be comprised of two or more wedge body members that are essentially identical, made of the same resiliently compressible material, and rigidly fixed together. The resiliently compressible material is not readily overpowered by the player wearing the training device such that the player cannot move his or her fingers toward each other from the desired orientation or minimum spread by more than 5 degrees, for example. The material selected for the central wedge body can be slightly compressible so that the fingers engaged therewith are not against a hard surface, such as a hard plastic or metal. Although slightly compressible, the central wedge body is formed so as not to be easily deformed. In this regard, the central wedge body should be substantially rigid during normal use. By one approach, when formed into the solid, central wedge body herein, the material cannot be compressed by more than about 5 degrees by adjacent fingers of a typical person wearing the device. The band is also formed of resilient material but one with more flexibility than the material for the central wedge body, such as an elastic material. By way of example, the band can be of an elastic, fabric material. In this manner, while a player has his or her adjacent fingers restricted in terms of how close they can be brought together by the generally rigid central wedge body, the player can more readily increase the spread of the adjacent fingers, if desired, via stretching the elastic band engaged against the outer sides of the fingers. This allows the player to spread their fingers more than the minimum spread provided by the central wedge body.

Advantageously, the training device can be comfortably worn by the player during both practice and games to develop muscle memory of correct finger spacing. Use of the training device is not limited to shooting drills. Because of the rigidity of the central wedge body of the device, the training device provided herein can also provide support to the fingers during impact and, in some instances, can reduce the occurrence of jamming of fingers.

A method for maintaining two adjacent fingers of a basketball player's hand in spaced and angled relation when shooting a basketball and a method for making a training device effective to maintain two adjacent fingers of a basketball player in spaced and angled relation are also provided.

DETAILED DESCRIPTION

Figure 1:
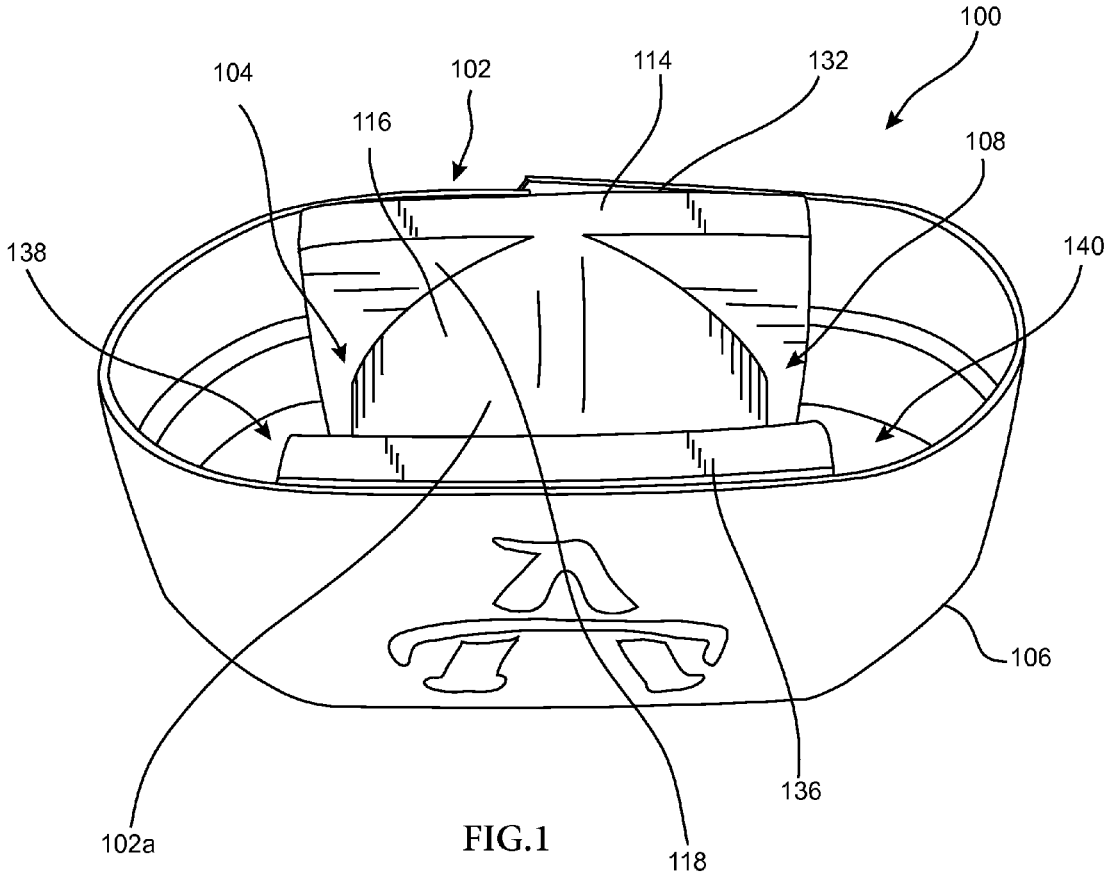
FIG. 1 is a front perspective view of a basketball training device formed of a central wedge body comprised of a single member and a band secured to the central wedge body.

A basketball training device for maintaining proper finger spacing on a basketball at the time of releasing the ball is provided. The basketball training device maintains two adjacent fingers in spaced and angled relation to enable the player to support and release the ball from those two fingers, thereby increasing the player's control of the ball and improving the accuracy of the basketball shot. In one aspect, the training device can be worn on the index and middle fingers. In another aspect the training device can be worn on the ring and middle fingers.

Because the middle finger is typically the longest finger, it is often difficult for a player to stably release the basketball from three fingers (e.g., the index, middle and ring fingers) or even two adjacent fingers at the same time. The length of the middle finger often causes the ball to shift towards either the index or ring finger during the shooting process to provide an unbalanced two finger release. The relative lengths of a player's fingers may determine which of the player's fingers typically support the ball prior to shooting and last touch the ball when releasing the shot. For example, if a player's ring finger is closer in length to the middle finger than to the index finger, the player may be more apt to use the middle and ring fingers to last touch the ball when releasing the ball. Similarly, if a player's index finger is closer in length to the middle finger than the ring finger, the player generally will have a natural tendency to last touch the ball with the index and middle fingers. Players often are taught to release the ball from certain fingers but the configuration taught may not be the optimal two finger release for that player. Also, injury can cause a player to favor one finger or pair of fingers when releasing the ball. If the player's middle finger is significantly longer than the adjacent fingers, the ball will likely last touch only the middle finger. Both the unbalanced two finger release and one finger release often result in reduced accuracy, inconsistency, and loss of ability to control distance shots. Generally, releasing the ball at the same time from two fingers having similar length will increase the control and accuracy of the player's aim when releasing the ball.

A basketball training device is provided herein to assist a player in proper finger spacing on the ball so that the ball can be stably released at the same time from two adjacent fingers, thereby increasing the player's control of the ball and improving the accuracy of the basketball shot. The training device is configured to provide a generally rigid wedge portion between two adjacent fingers on the player's shooting hand so that the fingers are spread apart and maintained in substantially spaced relation. By spreading the fingers apart, the fingers are also maintained in angled relation, such as at an angle of about 25 to about 65 degrees, and the effect of having fingers of differing lengths is minimized when the fingers are positioned on the ball.

Training devices that separate the fingers by other angles can also be used, if desired. The angle can depend, at least in part, on the relative lengths of the player's fingers. For example, if two adjacent fingers have similar lengths, a training device having a smaller angle can be useful. If two adjacent fingers have substantially different lengths (such as a difference of more than 0.25 inch), a training device providing an angle at the upper end of the described range, or an even larger angle if necessary, between the fingers may be useful. The angle may also depend on the player's comfort when wearing the training device. Training devices providing larger angles between the fingers may provide discomfort to the player or may interfere with other actions typical of playing basketball, such as dribbling and passing the ball. It is preferred that the training device be configured to be oriented between adjacent fingers and so that the upper or top surface is approximately level with or below the knuckles of the player's fingers so that the player can still bend his or her fingers normally and to minimize interference with dribbling, passing, and shooting motions.

Figure 2:
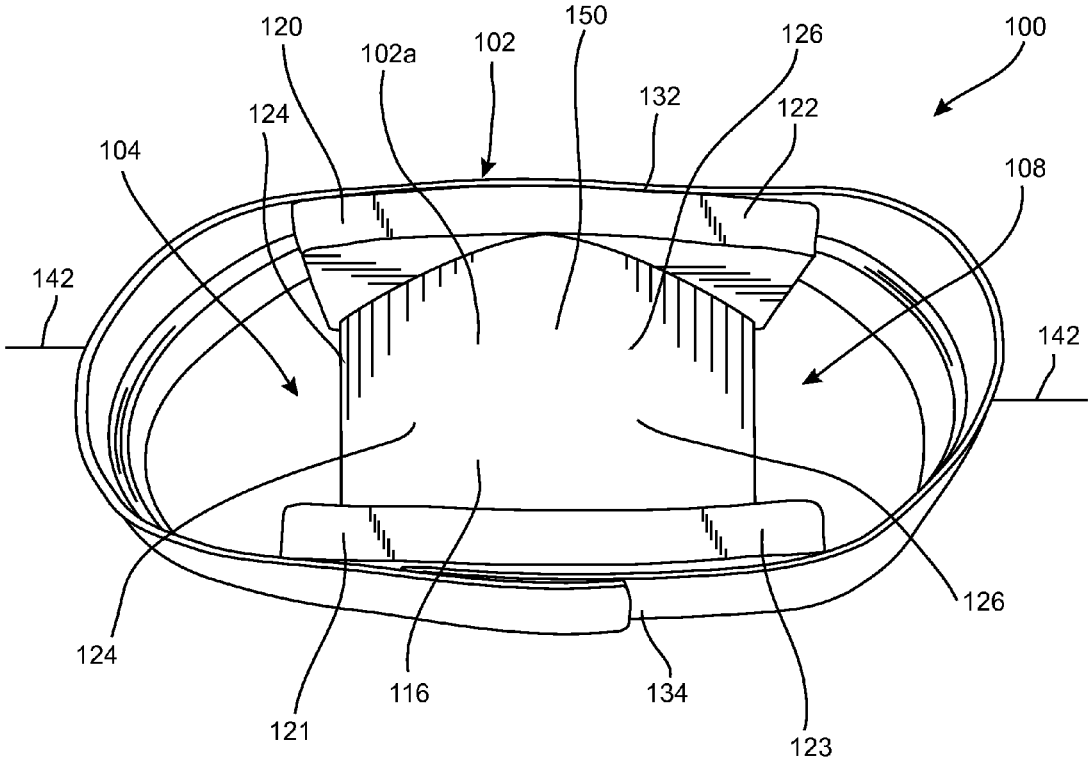
FIG. 2 is a top plan view of the training device of FIG. 1.
Figure 3:
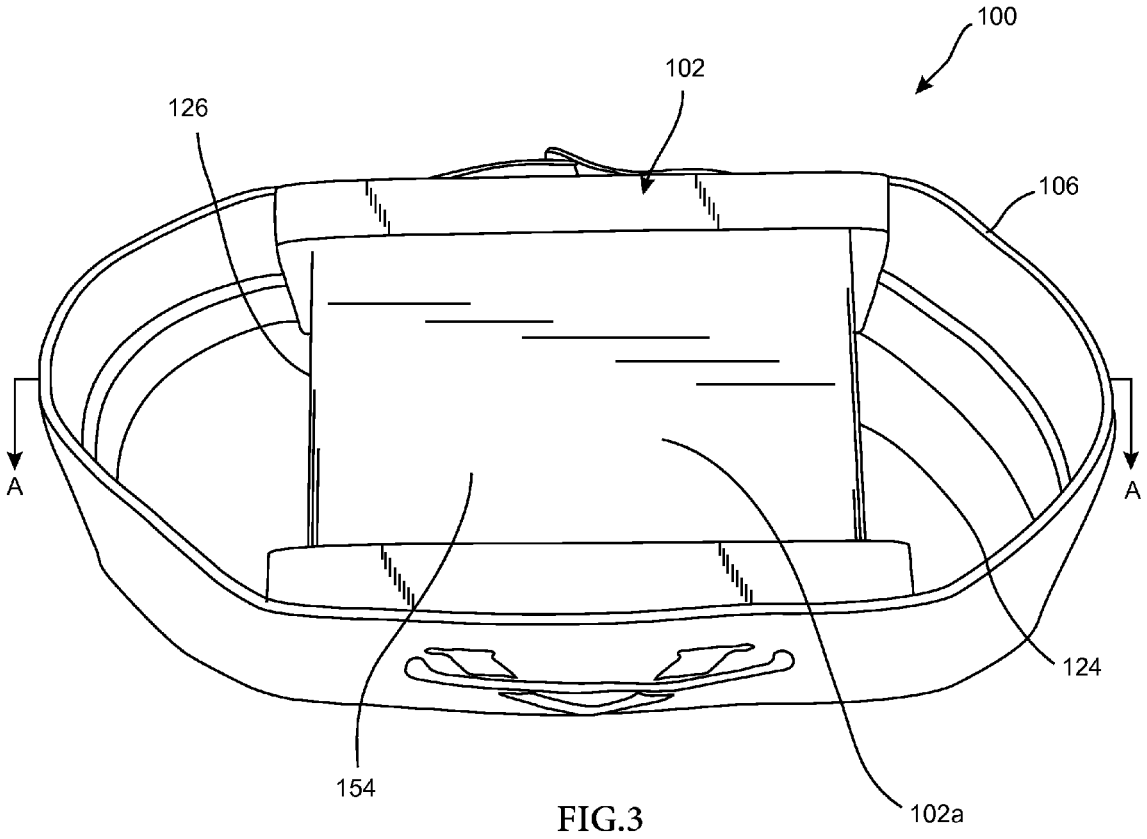
FIG. 3 is a bottom plan view of the training device of FIG. 2.

One exemplary embodiment of the training device is shown in FIGS. 1-3. The illustrated device 100 has two main components or parts including a central wedge member 102, including a wedge-shaped member 102*a* and a separate and distinct band member 106 secured thereto. The thick, solid nature of the central wedge member 102 provides increased resistance to deformation, particularly when the device is worn and a player tries to squeeze his or her adjacent fingers together. Central wedge member 102 has an outer flange portion 114, outer flange portion 136, and an upstanding wedge portion 116 projecting from inner surface 118 of the flange portion 114 and the inner surface (not shown) of the flange portion 136. Turning to FIG. 2, the flange portions 114 and 136 extend beyond the wedge portion 116 so that end sections 120 and 122 of flange portion 114 and end sections 121 and 123 of flange portion 136 cooperate with side surfaces 124 and 126 of the wedge portion 116 to form finger channels 104 and 108. Referring again to FIG. 1, the size of finger channels 104 and 108 is provided, at least in part, by band member 106 adhered to outer flat surfaces 132 and 134 of outer flange portions 114 and 136. The band member 106 is sized to form two openings 138 and 140, with each opening sized to permit passage of a player's finger therethrough. The band member 106 described hereinafter to allow the player more freedom in their finger movement in other directions, such as away from each other to increase the spread therebetween.

Turning again to FIG. 2, a longitudinal axis 142 extends between the openings. Upstanding wedge portion 116 includes opposing side surfaces 124 and 126. Side surface 124 is configured to contact the side of one of the adjacent fingers, and side surface 126 is configured to contact the side of the other of the adjacent fingers. By one approach, the side surfaces 124 and 126 have a generally concave surface that extend between lower narrow end 150 and, as shown in FIG. 3, upper wider end 154 of the wedge shaped body 102*a*.

Side surface 124 diverges from side surface 126 at the narrow end 150 to the wider end 154 of upstanding wedge portion 116 to provide the desired angled spacing between the two adjacent fingers. When the training device 100 is worn, the narrow end 150 of the upstanding wedge portion 116 is positioned adjacent the base between two fingers, and the wider end 154 is positioned farther up along the player's fingers but preferably below the player's knuckles. As shown in FIG. 3, the wider end 154 can be provided as a substantially planar surface.

Figure 4:
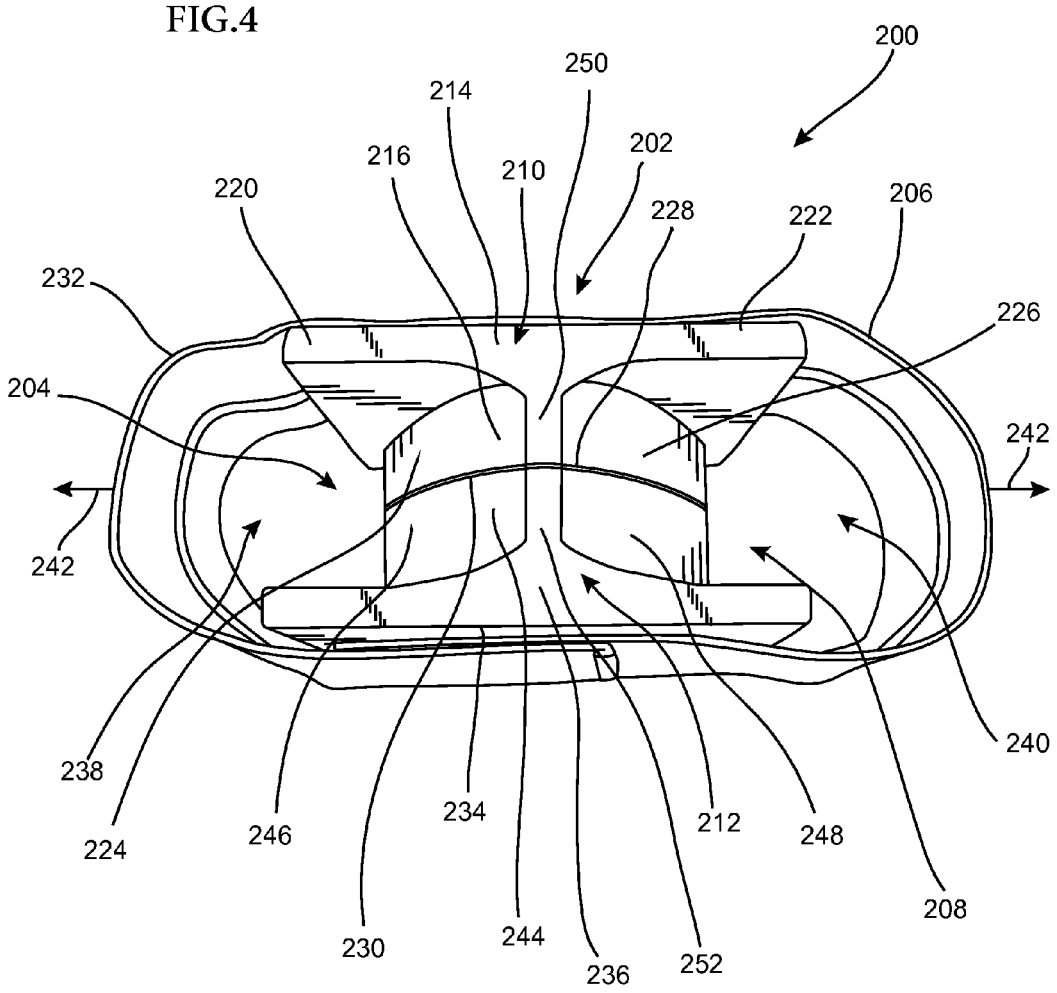
FIG. 4 is a top plan view of an embodiment of a basketball training device formed of a central wedge body comprised of two or more body members fixed together and a band secured to the central wedge body.
Figure 5:
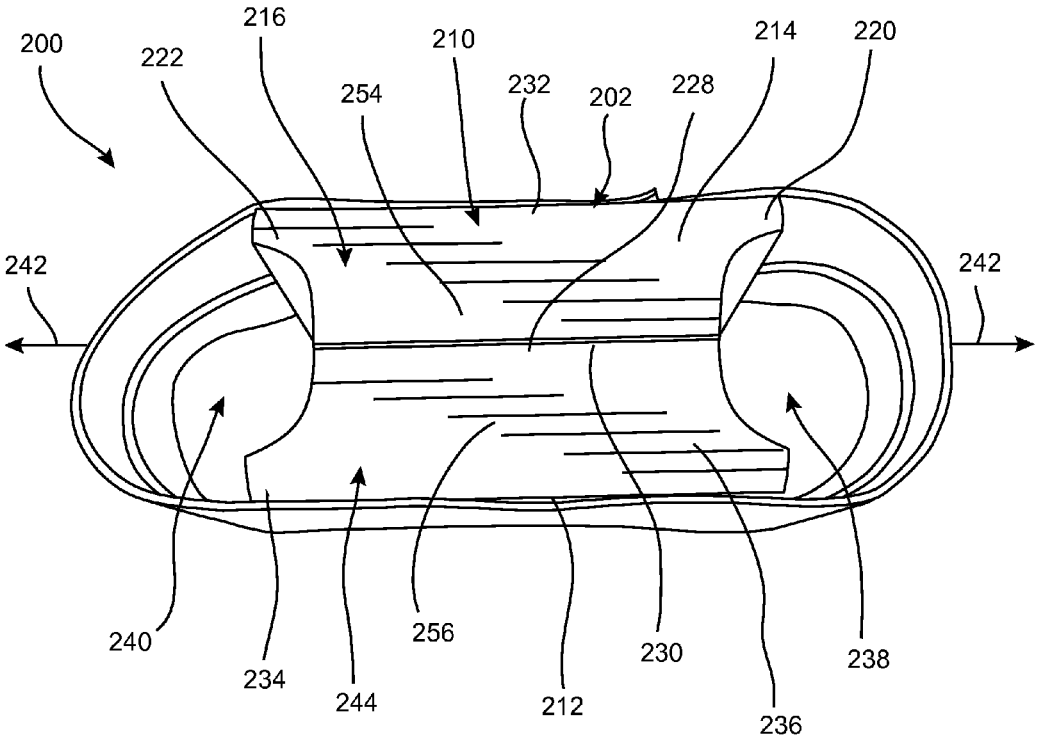
FIG. 5 is a bottom plan view of the training device of FIG. 4.

A further exemplary embodiment of the training device is shown in FIGS. 4 and 5. The illustrated device 200 comprises a central wedge member 202 and a band member 206 secured thereto. In one aspect, the central wedge body can be comprised of two or more body members that are essentially identical and of the same material, and are rigidly fixed together. The central wedge member 202 of FIGS. 4 and 5 comprises two substantially identical body members 210 and 212 that are coupled together, such as, for example, using an adhesive.

More particularly, body member 210 has an outer flange portion 214 and an upstanding wedge portion 216 projecting from inner surface 218 of the flange portion 214. The flange portion 214 extends beyond the wedge portion 216 so that end sections 220 and 222 of the flange portion cooperate with side surfaces 224 and 226 of the wedge portion 216 and corresponding features of the other body member 212 to form finger channels 204 and 208 when the innermost surface 228 of the wedge portion 216 is attached, such as by an adhesive, to the corresponding innermost surface 230 of the other body member wedge portion 244, as can be seen in FIGS. 4 and 5. Because of the thicker, solid nature of the connected wedge portions along with the adhesive therebetween, the wedge portions provide increased resistance to deformation, particularly when the device is worn and a player tries to squeeze his or her adjacent fingers together. In another aspect, the thinner flange end sections 220 and 222 are more flexible like the band member 206 described hereinafter to allow the player more freedom in their finger movement in other directions, such as away from each other to increase the spread therebetween.

As shown in FIG. 5, the band member 206 is adhered to outer surfaces 232 and 234 of outer flange portions 214 and 236, respectively, and is sized to form two openings 238 and 240, with each opening sized to permit passage of a player's finger therethrough. A longitudinal axis 242 extends between the openings. Turning back to FIG. 4, upstanding wedge portion 216 includes opposing side surfaces 224 and 226 and upstanding wedge portion 244 includes opposing side surfaces 246 and 248. Side surfaces 224 and 246 are configured to contact the side of one of the adjacent fingers, and side surfaces 226 and 248 are configured to contact the side of the other of the adjacent fingers. By one approach, the side surfaces 224, 226, 246, and 248 have a generally concave surface that extend between lower narrow ends 250 and 252 and, as shown in FIG. 5, upper wider ends 254 and 256 of the upstanding wedge portions 216 and 244, respectively. Side surfaces 224 and 246 diverge from side surfaces 226 and 248 at the narrow ends 250 and 252 to the wider ends 254 and 256 to provide the desired angled spacing of the two adjacent fingers. The narrow ends 250 and 252 of the upstanding wedge portions 216 and 244, respectively, are positioned adjacent the base between two fingers, and the wider ends 254 and 256 are positioned farther up along the player's fingers but preferably below the player's knuckles. As shown in FIG. 5, the wider ends 254 and 256 can be provided as substantially planar surfaces.

Figure 6:
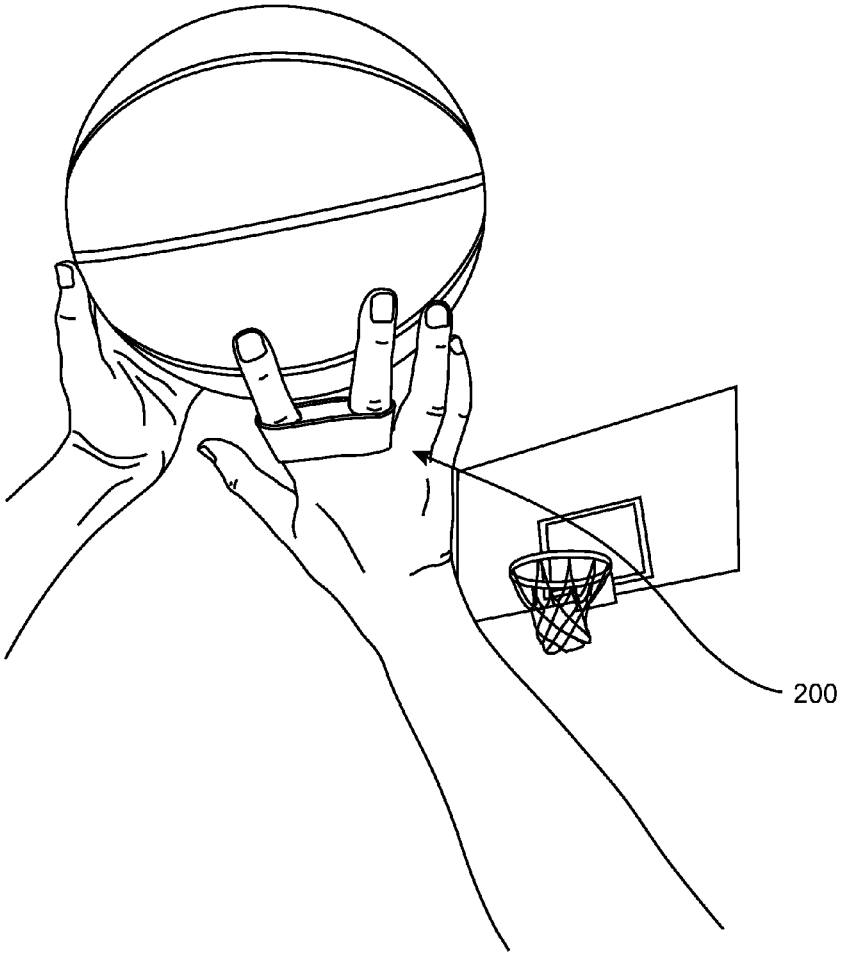
FIG. 6 is a photographic view of a player with his hands on the basketball while wearing the basketball training device on his index and middle fingers and showing the spreading of the index and middle fingers.
Figure 7:
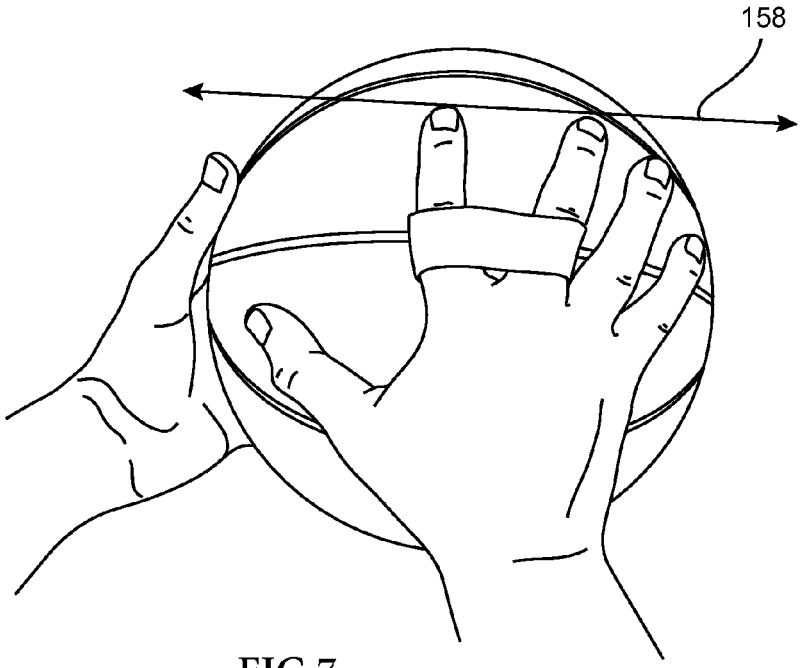
FIG. 7 is a photographic view of a player undertaking a basketball shooting motion while wearing the training device and showing the spaced and angled relation of the index and middle fingers.

FIG. 6 shows training device 200 being worn by a player on the player's index and middle fingers below the knuckles. FIG. 7 provides an additional view of the player wearing training device 200. As seen in FIG. 7, by separating and maintaining the player's index and middle fingers in spaced and angled relation, the difference in length of the player's fingers is minimized so that the point of intersection between lines running along the adjacent fingers is shifted to be closer to the bottom of the fingers than normal when the fingers are not spread. This creates a line 158 extending across the ends of the spread fingers that will more closely run parallel to the ground rather than obliquely relative thereto when undertaking a proper shooting motion. Such positioning of the fingers enables the index and middle fingers to both stably support the ball prior to and during the shot. Such positioning of the fingers on the basketball provides greater control during release of the ball when making a shooting motion.

Figure 8:
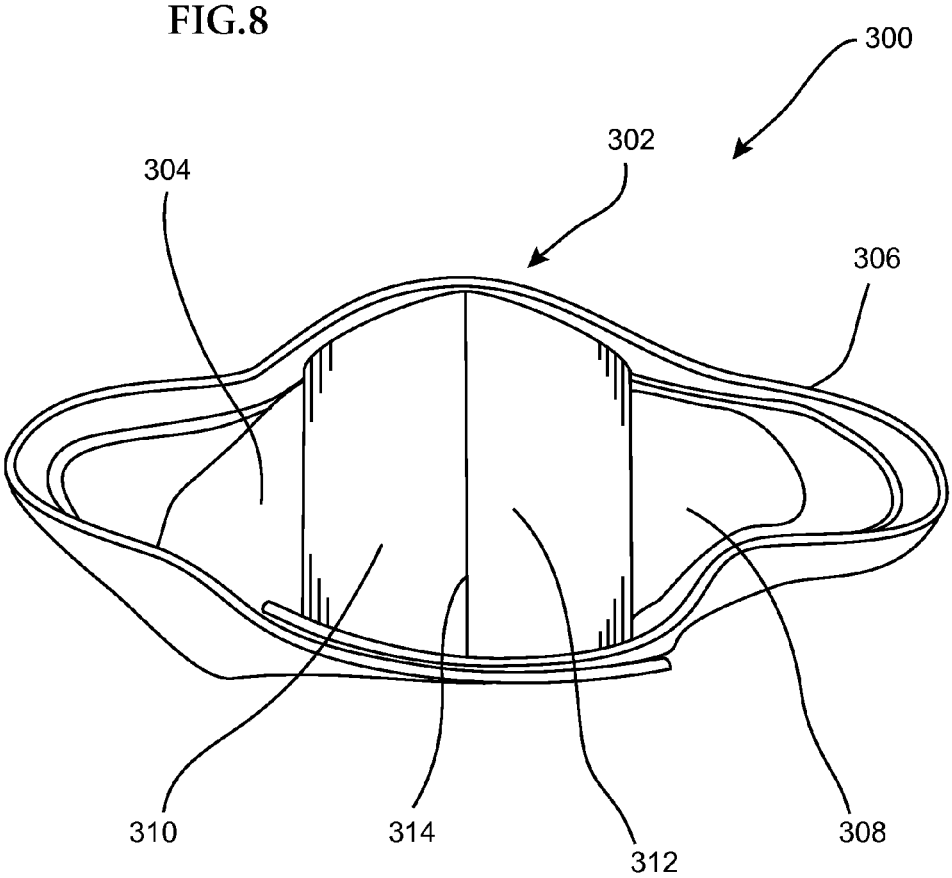
FIG. 8 is a top plan view of an alternative basketball training device having a triangular shape.
Figure 9:
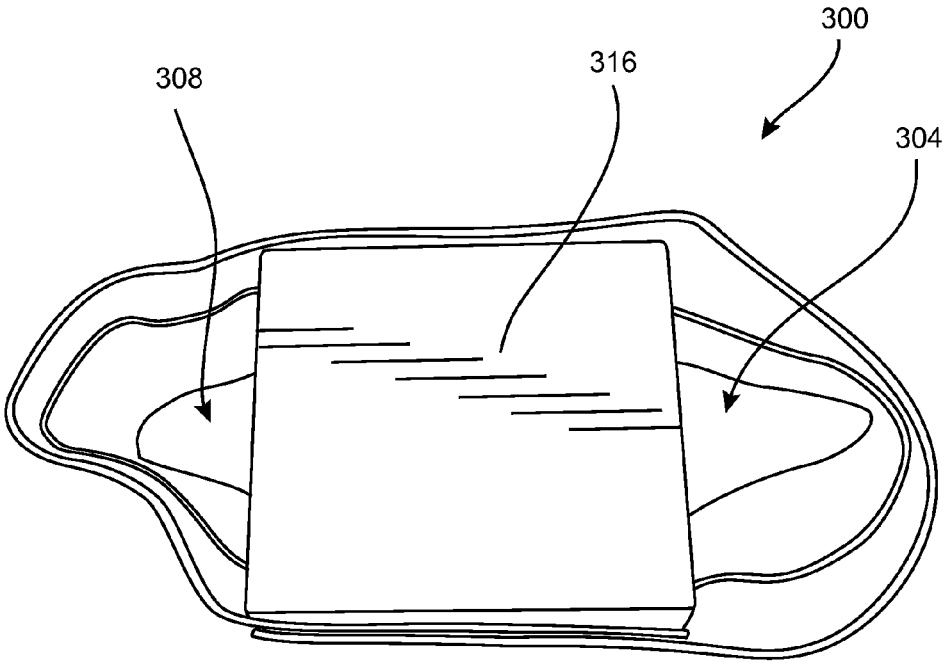
FIG. 9 is a bottom plan view of the training device of FIG. 8.

Another embodiment of the training device is shown in FIGS. 8 and 9. The illustrated training device 300 comprises a central wedge member 302 including a single wedge body 310 and a band member 306 secured thereto. The band member 306 is sized to form two openings 304 and 308, each opening sized to permit passage of a player's finger therethrough. As shown in FIG. 9, central wedge member 302 of training device 300 is generally triangular in cross section. Central wedge member 302 includes generally planar side surfaces 310 and 312, each side surface configured to contact the side of one of the adjacent fingers. Side surfaces 310 and 312 extend between a lower narrow end 314, shown in FIG. 8, and wider upper end 316, shown in FIG. 9. The narrow end 314 is positioned adjacent the base between two fingers, and the wider end 316 is positioned farther up along the player's fingers but below the player's knuckles.

Figure 10:
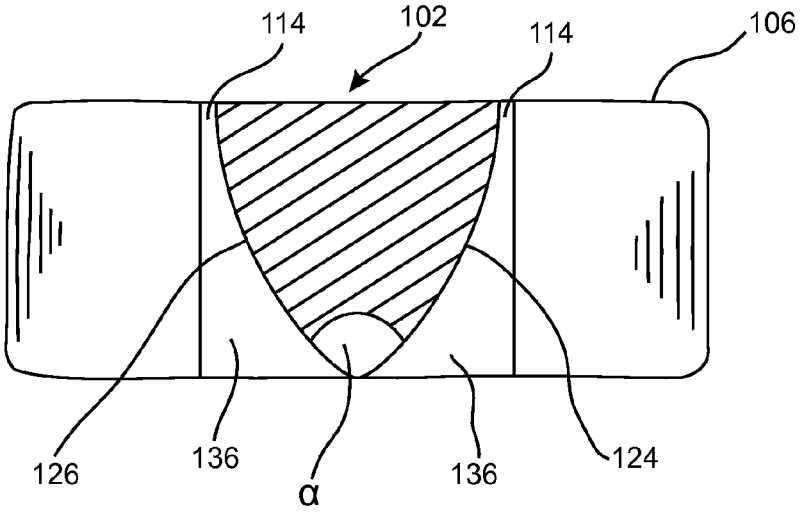
FIG. 10 is a cross-sectional view of the training device of FIG. 3 taking along line A-A.

In each of the embodiments of the training device 100, 200, and 300 described herein, the side surfaces (side surfaces 124 and 126 of FIG. 2; side surfaces 224, 226, 246, and 248 of FIG. 4; and side surfaces 310 and 312 of FIG. 8) diverge from the narrow end 150, 250, 252, and 314 to the wider end 154, 254, 256, and 316. The divergence from the narrow end to the wider end provides an angle of divergence. For example, FIG. 10 shows a cross section along line A-A of training device 100 of FIG. 3. Divergence of side surfaces 124 and 126 provides angle $\alpha$ therebetween. The angle of divergence can also be determined when the training device is worn by the player, such as by measuring the angle of the separation of the two adjacent fingers.

The central wedge body of the training devices described herein can be provided by a variety of resiliently compressible materials or combinations of materials. By "resiliently compressible," it is meant that the compressible material is not readily overpowered by the player wearing the training device such that the player has limited movement of his or her fingers toward each other from the desired orientation or minimum spread. The material selected for the central wedge body can be slightly compressible so that the fingers engaged therewith are not against a hard surface, such as a hard plastic or metal. Although slightly compressible, the central wedge body is formed so as not to be easily deformed. In this regard, the central wedge body should be substantially rigid during normal use. By one approach, when formed into the solid, central wedge body herein, the material cannot be compressed by more than about 5 degrees by adjacent fingers of a typical person wearing the device.

By one approach, the central wedge body of the device comprises about 80 percent silicone and about 20 percent rubber. In one aspect, the central wedge body is formed with less than about 85 percent silicone and, in another aspect, less than about 80 percent silicone, because higher percentages of silicone generally do not provide the desired rigidity to the device. For example, devices formed of higher percentages of silicone can be readily deformed by the player during wear to the extent that the player's fingers do not remain in the desired spaced relation. The method of manufacturing the central wedge body is not particularly limited. For example, the resiliently compressible material can be formed in a mold and then used, alone or in combination with other materials or portions, to provide the central wedge body.

By one approach, a band is used to secure the central wedge body in place between two of the player's fingers. In one aspect, the band is a resilient and flexible or elastic material such as thin strip of an elastic fabric material. The resilient material of the band generally has significantly more flexibility than the material for the central wedge body. By "resilient and flexible," it is meant that the material has elasticity sufficient to allow the wearer to readily insert a finger into each opening and slide the device into place below the player's knuckles while also having limited stretchability so that the device is prevented from substantially slipping or shifting out of place during movement of the player's fingers. In this manner, while a player has his or her adjacent fingers restricted in terms of how close they can be brought together by the generally rigid central wedge body, the player can more readily increase the spread of the adjacent fingers, if desired, via stretching the elastic band engaged against the outer sides of the fingers. This allows the player to spread their fingers more than the minimum spread provided by the central wedge body. In one aspect, the band should expand and contract with the movement of the wearer's fingers and not sag or gap during the shooting process. Such a fit assists in maintaining the device in the proper position on the fingers so that the wearer's fingers remain in spaced relation for shooting of the basketball. A band that is too loose fitting or has excessive elasticity is more likely to result in the device shifting such that the fingers are not kept in the proper orientation for releasing the ball during the act of shooting.

The band can be attached to the central wedge body by a variety of mechanisms. By one approach, the band can be adhered to the central wedge body using an adhesive. More particularly, the band includes intermediate portions adjacent the outer flat surfaces of the flanges of the central wedge portion and are secured thereto as by an adhesive therebetween. A suitable adhesive is sold by Permabond (Pottstown, Pa.). It may be advantageous to select an adhesive that is stable under high temperatures, so that the device can be washed. By another approach, the band can be attached to the central wedge body using stitching or by fasteners, such as hook and loop type fasteners. The particular mechanism selected to adhere the band to the central wedge body is not particularly limiting so long as the band does not readily detach from the central wedge body during use.

Advantageously, the training device can be comfortably worn by the player during both practice and games. Use of the training device is not limited to shooting drills. Because of the rigidity of the central wedge body of the device, the training device provided herein can also provide support to the fingers during impact.

Advantageously, a player using the training device described herein can develop muscle memory of the correct positioning and spacing of the fingers prior to and during release of the ball. By developing muscle memory, the player can decrease reliance on the training device.

When using the training device described herein, it is generally desirable to identify which fingers a player typically or naturally relies on for support and release of the ball rather than to try to modify the player's natural tendencies and cause greater disruption to the player's technique. By one approach, the player can slowly make a shooting motion and concentrate on identifying which finger or fingers last touch the ball. By another approach, a second person can stand behind the player and observe which of the player's fingers are used to balance the ball prior to shooting and which fingers last come off the ball upon release.

By another approach, there may be reasons to switch the fingers that last touch the ball. For example, if one of the index and ring fingers is much lower than the middle finger than the other of the index and ring finger, then it may be worthwhile for the player to use the taller of the index and ring fingers. However, because the player has likely been playing for a long time, it is generally disadvantageous to have a player switch the release fingers. For older and/or more experienced players, it is generally advisable to not change fingers. For younger or more inexperienced players, it may be advantageous to switch.

The training device can be provided in a variety of colors. By one approach, the training device is flesh colored so that the device is not readily visible from a distance. By another approach, the training device can be provided in a darker color. Logos or other markings may also be included, if desired, such as on the band. For example, a team name or team logo can be provided on the band.

A method for maintaining two adjacent fingers of a basketball player's hand in spaced and angled relation when shooting a basketball is also provided. The method includes placing a training device on two adjacent fingers of the player's hand, where the training device includes a central wedge body and a band secured to the central wedge body to form two openings on opposite sides of the central wedge body. When the player wears the training device on two adjacent fingers, preferably below the player's knuckles, and makes a shooting motion, the effect of having fingers of differing lengths is minimized so that a line extending across the tips of the fingers spread by the device will more closely run parallel to the ground rather than obliquely relative thereto.

A method for making the training device is provided. The method comprising securing a band to a central wedge body as described herein to form two openings on opposite sides of the central wedge body, each opening sized to permit passage of a finger therethrough. The method can further include securing two or more body members to each other using an adhesive to provide the central wedge body.

It will be understood that various changes, modifications, alterations, and combinations in the details, materials, and arrangements of the parts and components that have been described and illustrated in order to explain the nature of the basketball shooting training device and method as described herein may be made by those skilled in the art within the principle and scope of this disclosure.

What is claimed is:

1. A training device for spreading apart a pair of adjacent fingers of a basketball player when shooting a basketball, the training device comprising:

a central wedge member having a wedge configuration and being of a resiliently compressible material to have a generally rigid construction for spreading apart adjacent fingers of a basketball player that are in engagement with the generally rigid central wedge member; and a separate band member of resilient and flexible material different from the resiliently compressible material of the central wedge member and secured to the central wedge member to extend completely about the central wedge member in encircling relation thereto for generally keeping the adjacent fingers engaged with the central wedge member, with the generally rigid central wedge member providing greater resistance to shifting of the adjacent fingers toward each other over the resistance provided by the resilient and flexible band member to other finger movements of the adjacent fingers away from the central wedge member so that the generally rigid central wedge member establishes a minimum spread of the adjacent fingers with the resilient and flexible band member allowing the player to readily increase the spread of the adjacent fingers from the minimum spread thereof.

2. The training device according to claim 1, wherein the band member is secured to the central wedge member to form two openings on opposite sides of the central wedge member, with each opening sized to permit passage of a finger therethrough, and a longitudinal axis extending between the openings, the central wedge member having two opposing side surfaces, each of the opposing side surfaces configured to contact the side of one of the adjacent fingers, the side surfaces extending and diverging from a lower narrow end to an upper wider end of the wedge member to provide the desired angle between the two adjacent fingers, the resiliently compressible material of the central wedge member effective to maintain the fingers in spaced and angled relation so that the central wedge member is not compressible by the fingers by more than 5 degrees in the longitudinal direction.

3. The training device according to claim 2, wherein the central wedge member includes two outer flange portions and an upstanding wedge portion, the outer flange portions having flat outer surfaces, and the band member includes intermediate portions adjacent the flat outer surfaces of the flange portion and are secured thereto as by an adhesive therebetween.

4. The training device according to claim 2, wherein the opposing side surfaces have generally concave surfaces.

5. The training device according to claim 2, wherein the opposing side surfaces have a planar surface.

6. The training device according to claim 2, wherein the opposing side surfaces are oriented relative each other to separate the adjacent fingers in spaced relation at an angle of about 25 to about 65 degrees.

7. The training device according to claim 1, wherein the central wedge member is formed of a single piece.

8. The training device according to claim 1, wherein the central wedge member is formed of two or more pieces that are rigidly fixed together to be integral to form the central wedge member.

9. The training device according to claim 1, wherein the central wedge member resiliently compressible a material comprises than about 85 percent silicone.

10. A method for maintaining two adjacent fingers of a basketball player's hand in spaced and angled relation when shooting a basketball utilizing the device of claim 1, the method comprising placing a training device on two adjacent fingers of the player's hand, the training device comprising a central wedge member, a band secured to the central wedge member to form two openings on opposite sides of the central wedge member, with each opening sized to permit passage of a finger therethrough, and a longitudinal axis extending between the openings, the central wedge member having two opposing side surfaces, each of the opposing side surfaces configured to contact the side of one of the adjacent fingers, the side surfaces extending and diverging from a lower narrow end to an upper wider end of the wedge member to provide the desired angle between the two adjacent fingers, the central wedge member comprising a resiliently compressible material effective to maintain the fingers in spaced and angled relation so that the central wedge member is not compressible by the fingers by more than 5 degrees in the longitudinal direction.

11. The method according to claim 10, wherein the opposing side surfaces are oriented relative each other to separate the adjacent fingers in spaced relation at an angle of about 25 to about 65 degrees.

12. A method for making a training device effective to maintain two adjacent fingers of a basketball player in spaced and angled relation when shooting a basketball utilizing the device of claim 1, the method comprising securing a band to a central wedge member to form two openings on opposite sides of the central wedge member, with each opening sized to permit passage of a finger therethrough, and a longitudinal axis extending between the openings, the central wedge member having two opposing side surfaces, each of the opposing side surfaces configured to contact the side of one of the adjacent fingers, the side surfaces extending and diverging from a lower narrow end to an upper wider end of the wedge member to provide the desired angle between the two adjacent fingers, the central wedge member comprising a resiliently compressible material effective to maintain the fingers in spaced and angled relation so that the central wedge member is not compressible by the fingers by more than 5 degrees in the longitudinal direction.

13. The method according to claim 12, wherein the central wedge member is formed of a single piece.

14. The method according to claim 12, wherein the central wedge body is formed of two or more pieces that are rigidly fixed together to be integral to form the central wedge member.

15. The method according to claim 12, further comprising securing the two or more pieces to each other using an adhesive.

16. The method according to claim 12, wherein the opposing side surfaces have a concave surface.

17. The method according to claim 12, wherein the opposing side surfaces have a planar surface.

18. The method according to claim 12, wherein the central wedge body is formed of a material comprising less than about 85 percent silicone.

* * * * *